US010288375B2

(12) United States Patent
Spreadbury, III et al.

(10) Patent No.: US 10,288,375 B2
(45) Date of Patent: May 14, 2019

(54) AIR GUN WITH BARREL ALIGNMENT WEDGE

(71) Applicant: Sig Sauer, Inc., Newington, NH (US)

(72) Inventors: Sidney A. Spreadbury, III, Rochester, NH (US); Justin Daniel Heckert, Newmarket, NH (US); Krzysztof J. Kras, Fremont, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/910,258

(22) Filed: Mar. 2, 2018

(65) Prior Publication Data

US 2018/0252492 A1 Sep. 6, 2018

Related U.S. Application Data

(60) Provisional application No. 62/466,187, filed on Mar. 2, 2017.

(51) Int. Cl.
*F41B 11/648* (2013.01)

(52) U.S. Cl.
CPC ..... *F41B 11/648* (2013.01)

(58) Field of Classification Search
CPC ..... F41B 11/648
USPC ..... 124/65–67; 42/54, 75.04
See application file for complete search history.

(56) References Cited

U.S. PATENT DOCUMENTS

| | | | | |
|---|---|---|---|---|
| 4,367,723 | A * | 1/1983 | Resuggan | F41B 11/646 124/67 |
| 5,205,271 | A * | 4/1993 | Casas Salva | F41B 11/00 124/65 |
| 6,539,659 | B2 * | 4/2003 | Casas Salva | F41C 7/11 42/75.04 |
| 9,739,563 | B1 * | 8/2017 | Tharp | F41B 11/70 |
| 9,995,556 | B2 * | 6/2018 | Hall | F41C 7/11 |
| 2008/0295818 | A1 * | 12/2008 | Styles | F41A 21/48 124/83 |
| 2010/0229844 | A1 | 9/2010 | Gore | |

* cited by examiner

*Primary Examiner* — Reginald S Tillman, Jr.
(74) *Attorney, Agent, or Firm* — Finch & Maloney PLLC

(57) ABSTRACT

An air gun and methods of manufacture are provided. The air gun includes a barrel block pivotally attached to a compression fork. The barrel block includes two lateral wedges, one extending from each side of the barrel block. The wedges interact with complementary surfaces on the compression fork. This interaction reduces both lateral and vertical movement of the barrel resulting in greater accuracy and reduced need for re-sighting the air gun.

20 Claims, 11 Drawing Sheets

AIR GUN WITH BARREL ALIGNMENT WEDGE

CROSS-REFERENCE TO RELATED APPLICATIONS

This application claims the benefit of U.S. Provisional Patent Application No. 62/466,187, filed on Mar. 2, 2017, which is herein incorporated by reference in its entirety.

FIELD OF THE DISCLOSURE

This disclosure relates to air guns, and more particularly to structures for aligning the barrel of a break barrel air rifle.

BACKGROUND

Air guns are small arms, such as air pistols or rifles, that are commonly used for hunting, recreational shooting, and competitive shooting, such as field target events. Unlike firearms that fire projectiles using chemical or explosive reactions, air guns utilize pressurized air or gas to propel projectiles (e.g., pellets or small balls called "BBs"). For instance, air guns, such as spring-piston air guns, use a mechanical means (e.g., a spring and piston) to compress air within a cylinder. One type of spring-piston air gun is a break barrel air rifle in which the rifle is hinged near its midpoint. The barrel serves as a lever that is operated by the user about the hinge to compress the spring. Upon firing, the spring is released and the air in the compression cylinder is quickly compressed. This compressed air is channeled to the breech and causes the projectile to be propelled from the barrel of the air gun.

SUMMARY

One example embodiment of the present disclosure provides a break barrel air gun comprising a barrel block attached to a barrel, the barrel block having two opposed substantially vertical sides, each side including a wedge extending laterally outwardly, and a compression fork pivotally attached to the barrel block, the compression fork including two inclined shelves each having upper surfaces configured to contact lower surfaces of the wedges when the air gun is in a closed configuration. The lower surfaces of the wedges can extend laterally at an angle between 90° and 180° and can be greater than 110° from the vertical sides of the barrel block. The lower surfaces of the wedges and the upper surfaces of the inclined shelves can be planar. The surface area of a wedge that is in contact with an inclined shelf can be greater than 0.25 $cm^2$ and the length of the wedge can be greater than 10 mm. The wedges can be formed on the upper surface of the barrel block and may be integral with the barrel block. The compression fork may be attached to a compression tube so that the compression tube, compression fork, barrel block, and barrel may be in fluid communication with one another. The interaction between the wedges and the inclined shelves can provide horizontal and vertical forces to keep the barrel aligned with the compression tube when the air gun is in the ready to fire position. The wedges can be in contact with the inclined shelves to maintain at least one of horizontal alignment and vertical alignment of the barrel with the compression tube when the air gun is in a ready to fire position. The air gun may further comprise a stock connected to the compression fork and a scope mounted on the compression tube. The wedges can include a triangular cross-sectional shape. The wedges can be one of a continuous plane or a plurality of interrupted co-planar segments. The lower surfaces of the wedges can be curved surfaces configured to contact upper curved surfaces of the inclined shelves. The wedges may include a length to width ratio of greater than 2:1. The barrel block can further include a detent configured to maintain the wedges of the barrel block in contact with the inclined shelves of the compression fork. The compression fork can include a pair of arms on which the inclined shelves are disposed, the inclined shelves extending downwardly toward an inside surface of each arm.

One example embodiment of a method of making the air guns disclosed herein includes joining the barrel block to the compression fork so that the wedges disposed on the barrel block are in contact with inclined shelves disposed on the compression fork, match drilling a pivot pin hole through the compression fork and barrel block, and pivotally securing the compression fork to the barrel block by passing a pivot pin through the pivot pin hole. The method may further comprise pressing the breech face of the barrel block against the corresponding face of the compression fork prior to drilling. The barrel block can be joined with the compression fork so that the barrel block and compression fork are placed together in a firing mode configuration.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
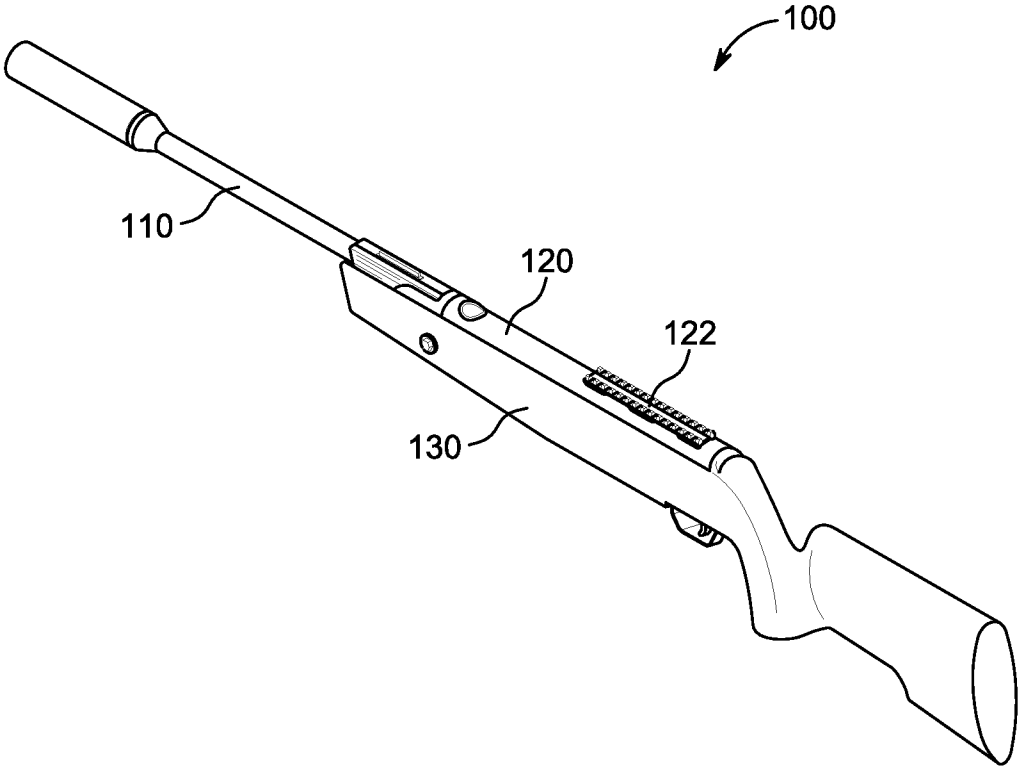
FIG. 1 is a perspective view of an air gun configured in accordance with an embodiment of the present disclosure.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

In one aspect, a system is described that allows a break barrel air rifle to provide precise and repeatable barrel positioning before each shot. The barrel block of the break barrel air rifle can include two angled wedges that are laterally mounted on opposed vertical surfaces of the barrel block. These wedges provide angled planar surfaces that contact complementary receiving surfaces on the body of the air gun, such as on the compression fork. The wedges can provide flat surfaces that may be neither parallel nor perpendicular to the vertical axis of the air gun. These angled surfaces can reduce unwanted barrel movement in both the horizontal and vertical directions.

To cock and load a break barrel air gun, the barrel of the gun is broken from the air gun body and serves as a lever to provide mechanical advantage for compressing the spring. When the barrel is fully broken, the breech is exposed and a pellet or other projectile can be loaded into the breech. The barrel is then closed and the air gun is ready to shoot. This process is repeated for every shot and the repeatability of the alignment of the barrel in relation to the body of the air gun between shots is important for accurate shooting as even a slight variation in barrel alignment leads to significant inaccuracies. While iron sights can be mounted on the gun barrel, sights such as telescopic sights and laser sights are typically mounted on the body of the air gun, such as on the compression tube. This means that for consistent, accurate shooting, the alignment of the barrel to the compression tube needs to be the same as when the gun was sighted in.

Horizontal deviation of the barrel (side to side) is typically controlled by the insertion of shims or spring washers at the barrel pivot pin between the barrel block and the fork that extends from the compression tube. Manufacturing tolerances dictate that there is a range of clearance distances between the barrel block and the fork, and the width of the barrel block is typically smaller than the width of the opening in the fork by at least a few thousandths of an inch. This amount of clearance is enough to allow for some side to side movement of the barrel, even with the pivot pin installed. The use of one or more shims can reduce this clearance and as a result, reduces the amount of side to side play. Shims or spring washers however can increase the friction between the barrel block and the fork, resulting in a more difficult cocking procedure. The shims also wear over time, resulting in an increasing amount of play as the number of shooting cycles increases.

Vertical alignment of the barrel is typically defined by the point where the rearward facing surface of the barrel block is stopped by the complementary surface on the interior of the fork. In theory, this involves broad surface to surface contact but in practice, again due primarily to manufacturing tolerances, typically results in one or two points of contact between the surfaces. At these points of contact, surface wear results from each cycle of the air gun and the vertical alignment of the barrel is altered, resulting in an increasing amount of error between the expected and the actual vertical alignment of the barrel in relation to the compression tube.

General Overview

Figure 2:
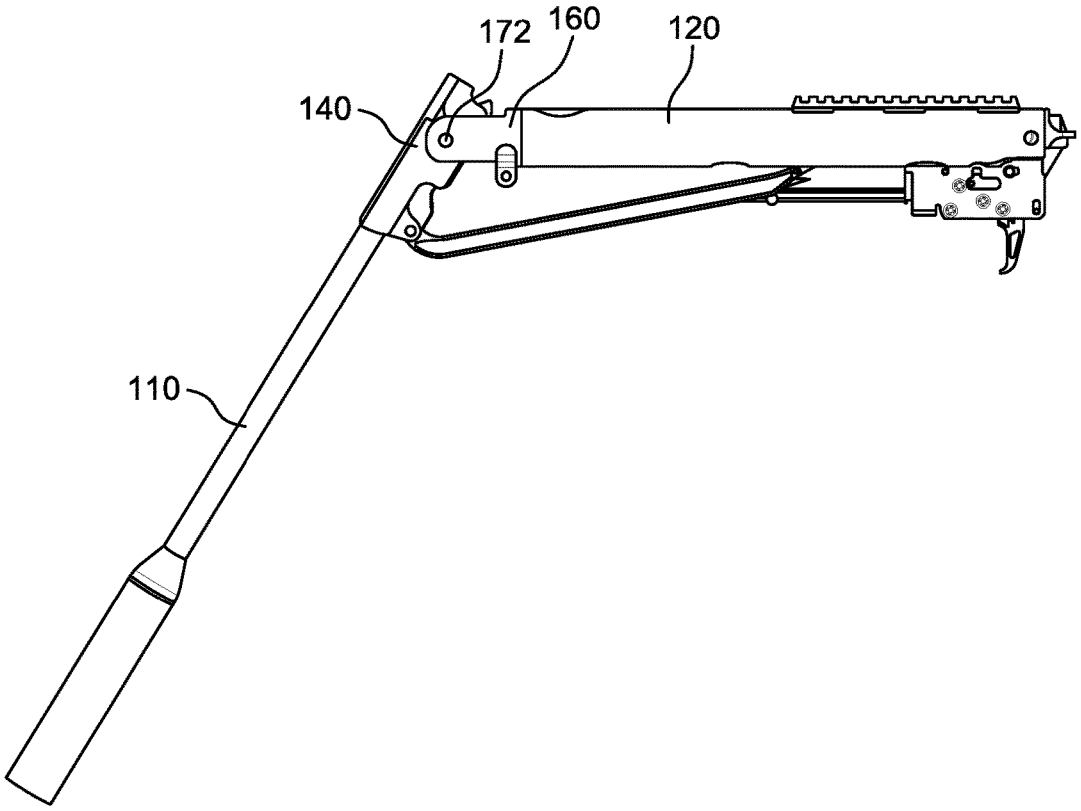
FIG. 2 is a side view of an action assembly of the air gun shown in FIG. 1, in accordance with an embodiment of the present disclosure.

FIG. 1 provides a perspective view of a break barrel air gun 100 that includes barrel 110, compression tube 120 and stock 130. As used herein, an air gun is a small arm (e.g., a pistol or rifle) that propels projectiles by means of a pressurized fluid such as air, carbon dioxide or nitrogen. Air guns typically propel metallic or polymer projectiles, typically either non-spherical pellets, or spherical balls called BBs. The air gun 100 may be configured in a variety of calibers including, but not limited to 0.177 (4.5 mm) and 0.22 (5.5 mm & 5.6 mm) calibers. Together, the stock 130 and compression tube 120 are considered the body of the air gun 100, separate from the barrel 110. A scope or other sighting device can be attached to mounting rails 122 on top of the compression tube 120. FIG. 2 provides a side view of the action components of air gun 100. As shown, the barrel 110 has been broken and is about half way through the cocking cycle. Barrel 110 is attached to barrel block 140 which is joined to compression fork 160 by barrel pivot pin 172, around which the barrel 110 rotates to compress the spring in compression tube 120. Fork 160 is securely attached to the forward end of compression tube 120 so that there is no movement between the two components. Fork 160 can be integral to compression tube 120 and may be permanently attached by, for example, welding, or may be removably attached by, for example, one or more set screws. Barrel pivot pin 172 passes through both arms of compression fork 160 as well as through barrel block 140.

Figure 3:
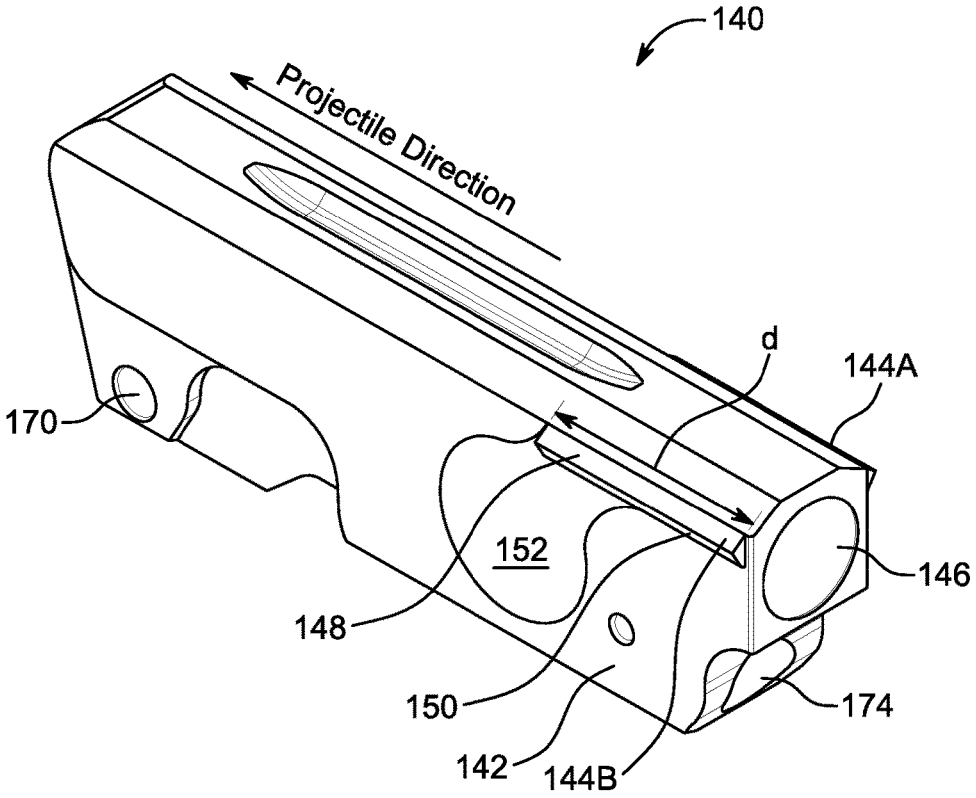
FIG. 3 is a perspective view of a barrel block in accordance with an embodiment of the disclosure.
Figure 4:
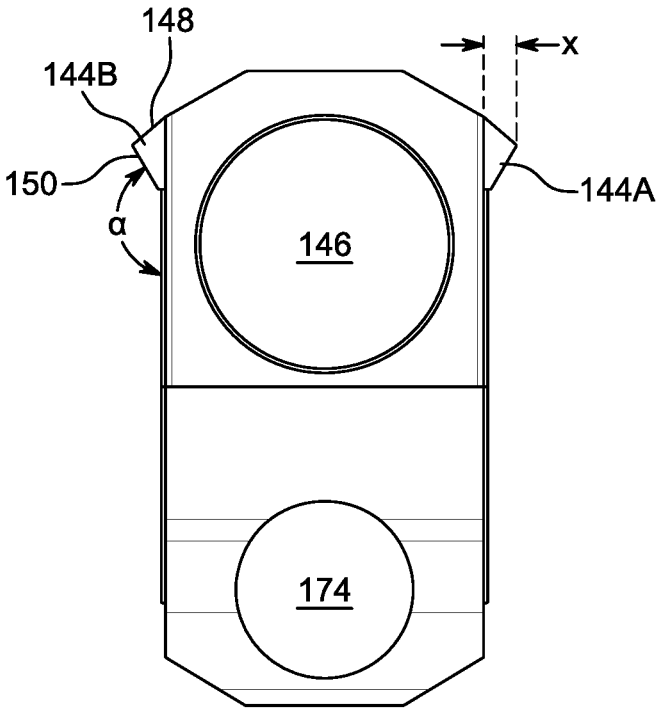
FIG. 4 is an end view of the barrel block embodiment illustrated in FIG. 3.

FIG. 3 provides a perspective view of barrel block 140 isolated from the rest of the air gun 100. Orifice 146 is sized to accept the barrel 110 and passes through the barrel block 140 from the proximal (breech) end to the terminal end (in the direction of the projectile as indicated by the arrow). After assembly, orifice 146 will be fitted with the barrel 110 and configured to accept a pellet or other projectile. Through hole 170 accepts a pin that connects the barrel block 140 with the cocking linkage. Orifice 174 is designed to accept a spring and plunger for interacting with a detent pin on the compression fork 160. Wedges 144A and 144B extend outwardly from vertical surfaces 142. The wedges 144 can be triangular in cross section, although in some cases the upper surface is curved. Each wedge has a length d, an upper surface 148 and a lower surface 150. The wedges 144 can be one continuous plane or can be two or more interrupted co-planar segments. The length d can be long enough to provide multiple places of contact, or a planar surface of contact, when the barrel block 140 comes to rest against the compression fork 160. For example, wedge length d may be from 5 to 50 mm, from 10 to 40 mm, or from 10 to 25 mm. Contact (lower) surface 150 can be planar and can be aligned with the axis of barrel 110. Contact surface 150 has a length that is typically the same as the length of the wedge 144. It has a width that is adequate to provide solid, broad contact with the compression fork 160. In some embodiments, the width of contact surface 150 can be from 1 to 15 mm, from 2 to 15 mm or from 2 to 10 mm. Thus, the total surface area of contact surface 150 may be, for example, greater than 10 $mm^2$, greater than 25 $mm^2$, greater than 50 $mm^2$, greater than 100 $mm^2$ or greater than 200 $mm^2$. In embodiments where the contact area includes two or more interrupted surfaces, the total surface area of contact may be less than if a continuous surface is used. Contact (lower) surface 150 can have a length to width ratio of greater than 2:1, greater than 5:1 or greater than 10:1. As shown in the end view provided in FIG. 4, lower surface 150 forms a lateral angle a with vertical surface 142 that, in various embodiments, is greater than 0°, greater than 90°, less than 90° or less than 180°. In particular upward sloping embodiments, $\alpha$ is between 100° and 170°, between 120° and 165°, or between 130° and 160°. Wedges 144 can have a width x, extending horizontally as shown, that can be selected to provide a planar surface large enough to contact the complementary fork surface at multiple points. In various embodiments, the width x of wedge 144A and/or 144B is between 0.02 inch and 0.25 inch. Wedges 144 can be produced as an integral part of the barrel block 140 during machining of barrel block 140 or may be attached in a secondary operation by, for example, welding. Barrel block 140 and wedges 144 may be made of the same material and can be, for example, a metal or alloy such as steel, brass or aluminum. Region 152 on surface 142 (one per side) protrudes by machining down the area around it by several thousandths of an inch. In a later production stage, the barrel pivot pin hole can be drilled in this region, and by having the region protrude, the barrel can pivot freely without rubbing against other portions of the air gun 100.

Figure 5:
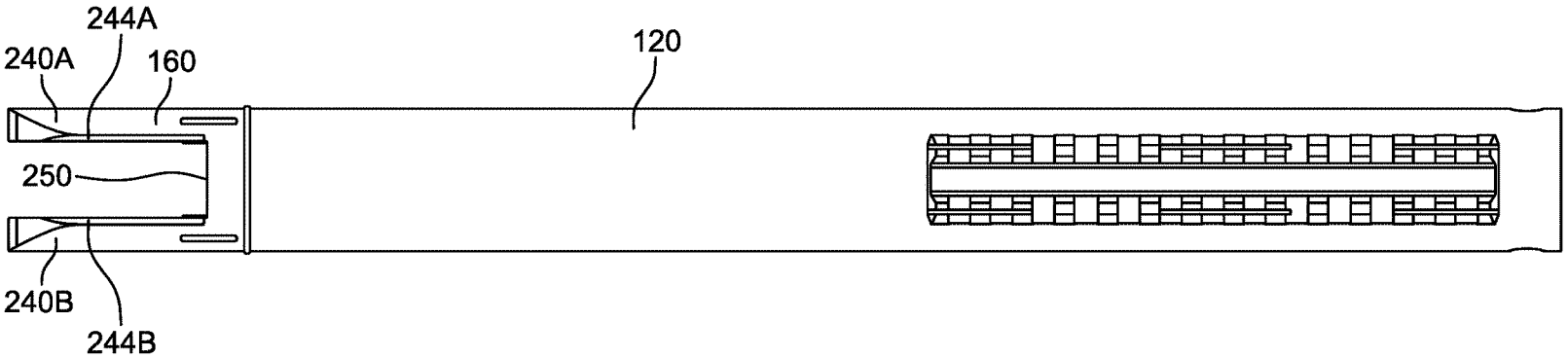
FIG. 5 is a top view of a compression tube and compression fork in accordance with an embodiment of the present disclosure.
Figure 6:
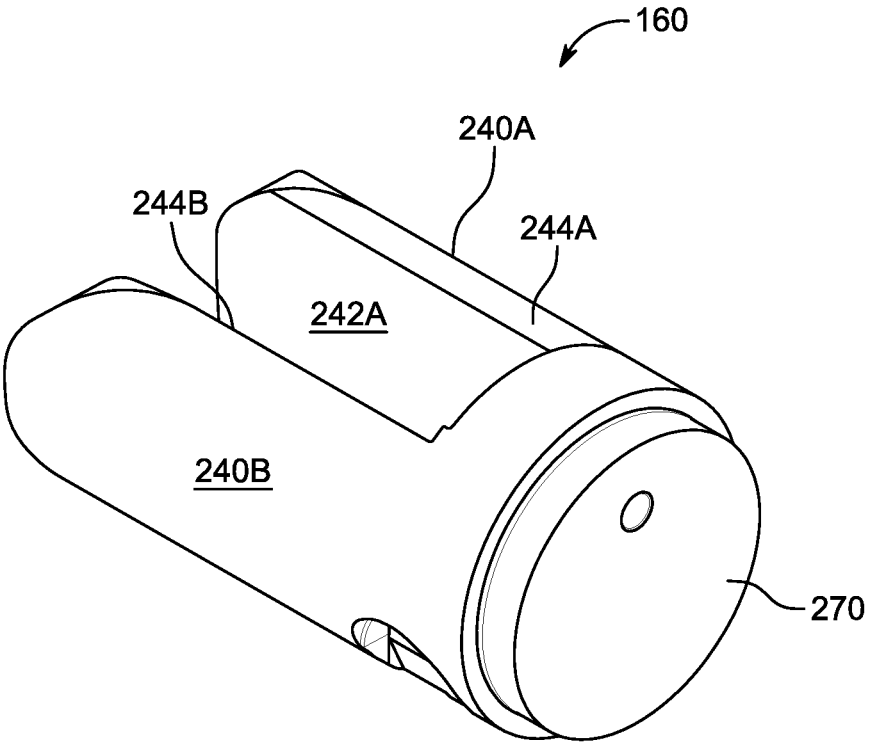
FIG. 6 is a perspective view of a compression fork in accordance with an embodiment of the present disclosure.
Figure 7:
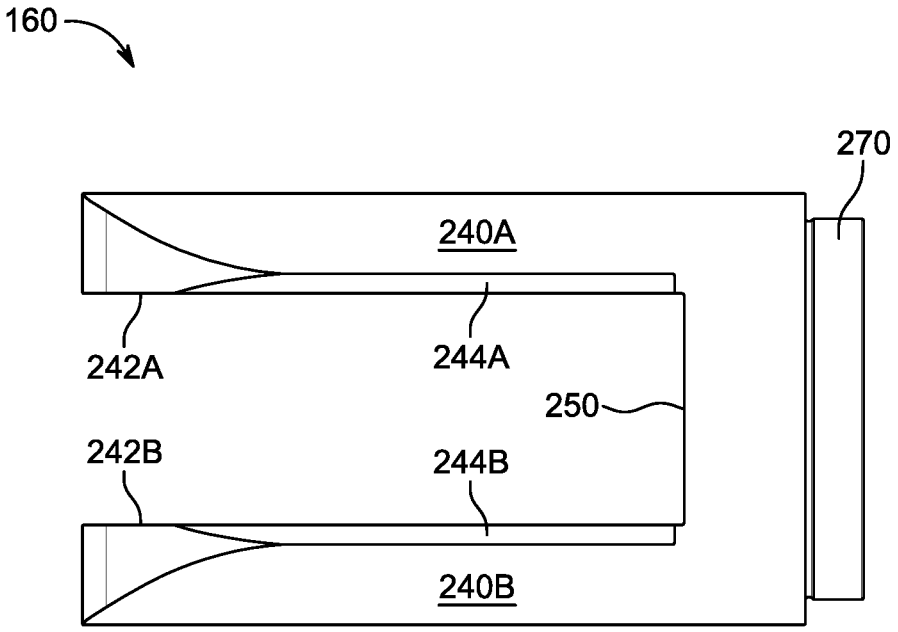
FIG. 7 is a top view of the compression fork of FIG. 6.

Wedges 144A and 144B interact with compression fork 160 to fix and stabilize the alignment of the barrel 110. Different views of compression fork 160 are provided in FIGS. 5, 6 and 7. FIG. 5 provides a top view of the compression fork 160 attached to compression tube 120. FIG. 6 provides a perspective view of compression fork 160 isolated from the compression tube 120, and FIG. 7 provides a top view of compression fork 160, separate from compression tube 120. Fork 160 includes two arms, 240A and 240B. As more clearly seen in FIGS. 6 and 7, the arms 240 include flat, inner vertical walls 242A and 242B. Compression fork 160 also includes rear wall 250 that includes an orifice for providing fluid communication between compression tube 120 and the breech of barrel block 140. At the top of walls 242A and 242B, inclined shelves 244A and 244B slant downwardly toward the inside surface of each arm 240A and 240B. Inclined shelves 244A and 244B can be planar and are designed to contact wedges 144 of barrel block 140 when the barrel 110 is closed. As with the wedge surfaces, the inclined shelves 244 may be continuous surfaces or a series of interrupted surfaces. Inclined shelves 244A and 244B can be designed to achieve maximum surface contact with the wedges 144 of barrel block 140. For example, if the lower wedge surface 150 is planar, the inclined shelves 244A and 244B can also be planar. If lower wedge surface 150 is curved, then inclined shelves 244 can include a complementary curve. Inclined shelves 244A and 244B can be machined into the compression fork 160 during production of the piece. The compression fork 160 can comprise similar materials to that of the barrel block 140 and in many cases may be of the same material. For example, if the barrel block 140 is steel, the compression fork 160 can also be steel. The angle of incline of shelves 244A and 244B is referred to as angle $\beta$ and is measured from the plane of vertical walls 242A and 242B, respectively. In different embodiments, $\beta$ can be between 0° and 180°, between 0° and 90°, between 10° and 80°, between 15° and 60°, or between 20° and 50°. For example, if the angle $\alpha$ of the lower wedge surface is 155°, then the complementary angle $\beta$ will be about 25° so that the two surfaces can achieve maximum surface to surface contact when the barrel 110 is closed. To maximize surface contact between barrel block 140 and fork 160 the length and width of inclined shelves 244 may be the same or similar to that of lower wedge surface 150. In some embodiments, the width of inclined shelves 244 can be from 1 to 15 mm, from 2 to 15 mm or from 2 to 10 mm. The length of each inclined shelves 244 can be, for example, from 5 to 50 mm, from 10 to 40 mm, or from 10 to 25 mm. Thus, the surface area of each inclined shelf 244 may be greater than 25 $mm^2$, greater than 50 $mm^2$, greater than 100 $mm^2$ or greater than 200 $mm^2$.

Example Air Gun Application

Figure 8:
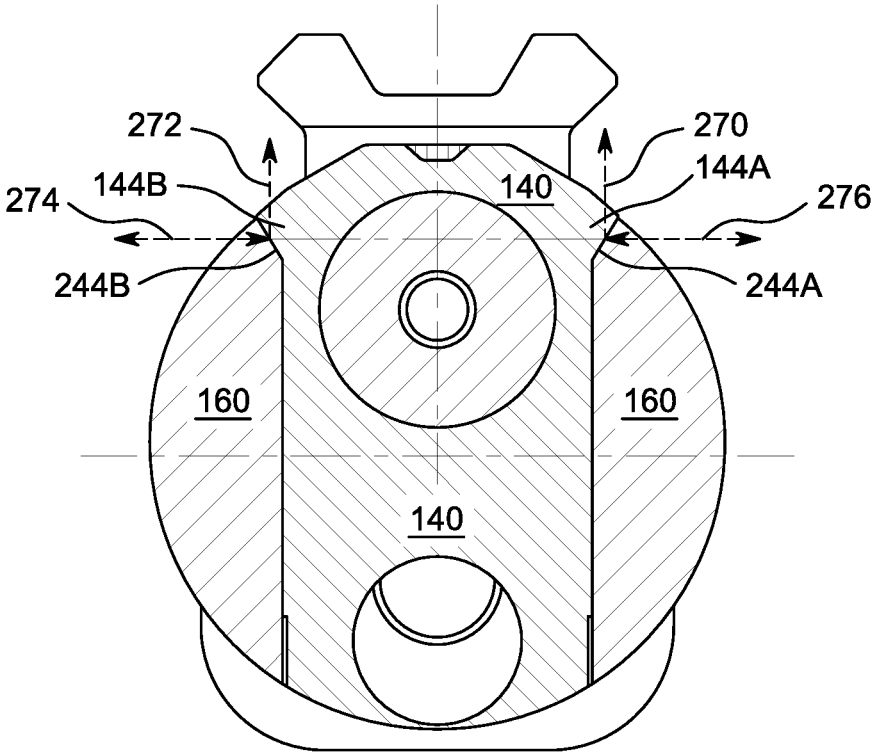
FIG. 8 is a cutaway view of a barrel block engaged with a compression fork in accordance with an embodiment of the present disclosure.

FIG. 8 provides a cross-sectional view of barrel block 140 and compression fork 160 when the two parts are mated and the barrel 110 is in the closed position. Wedges 144A and 144B are in contact with inclined shelves 244A and 244B. As provided, barrel block 140 is positioned in relation to compression fork 160 by the interaction of the wedges 144 with the shelves 244. As shown, contact surfaces are about 30° from vertical. Dotted lines 274 and 276 represent the horizontal forces that result from this interaction and these opposing horizontal forces serve to stabilize any side-to-side motion or variation of the barrel 110. Dotted lines 270 and 272 represent a vertical force that stabilizes the barrel 110 and barrel block 140 in the vertical direction. Spring detent (Plunger) 190 (not shown) keeps the barrel block 140 pulled down into the compression fork 160 and assures that the wedges 144 are held securely against the shelves 244.

Figure 9A:
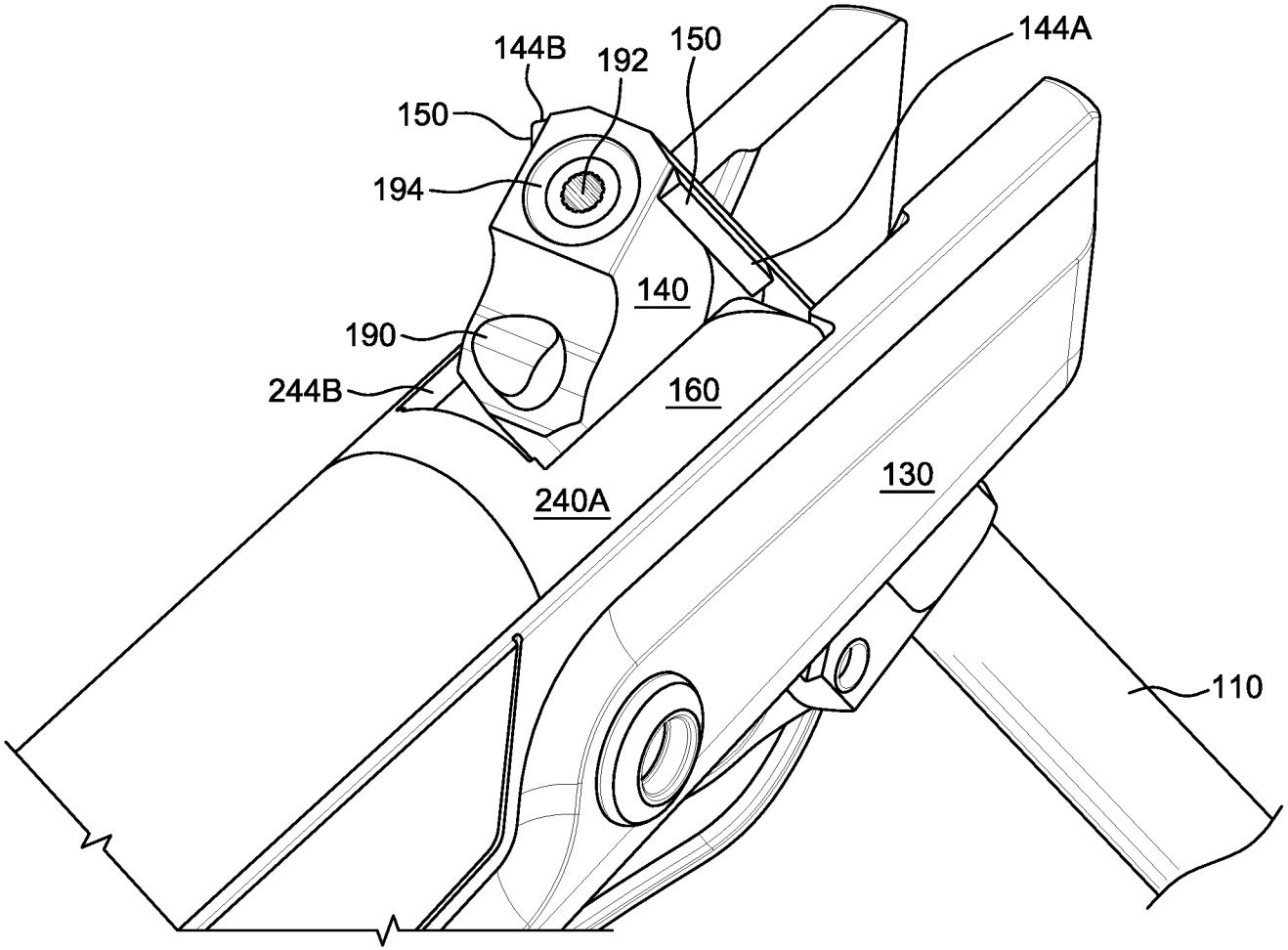
FIGS. 9A, 9B and 9C provide three perspective views of a barrel block and compression fork in operation in accordance with an embodiment of the present disclosure.
Figure 9B:
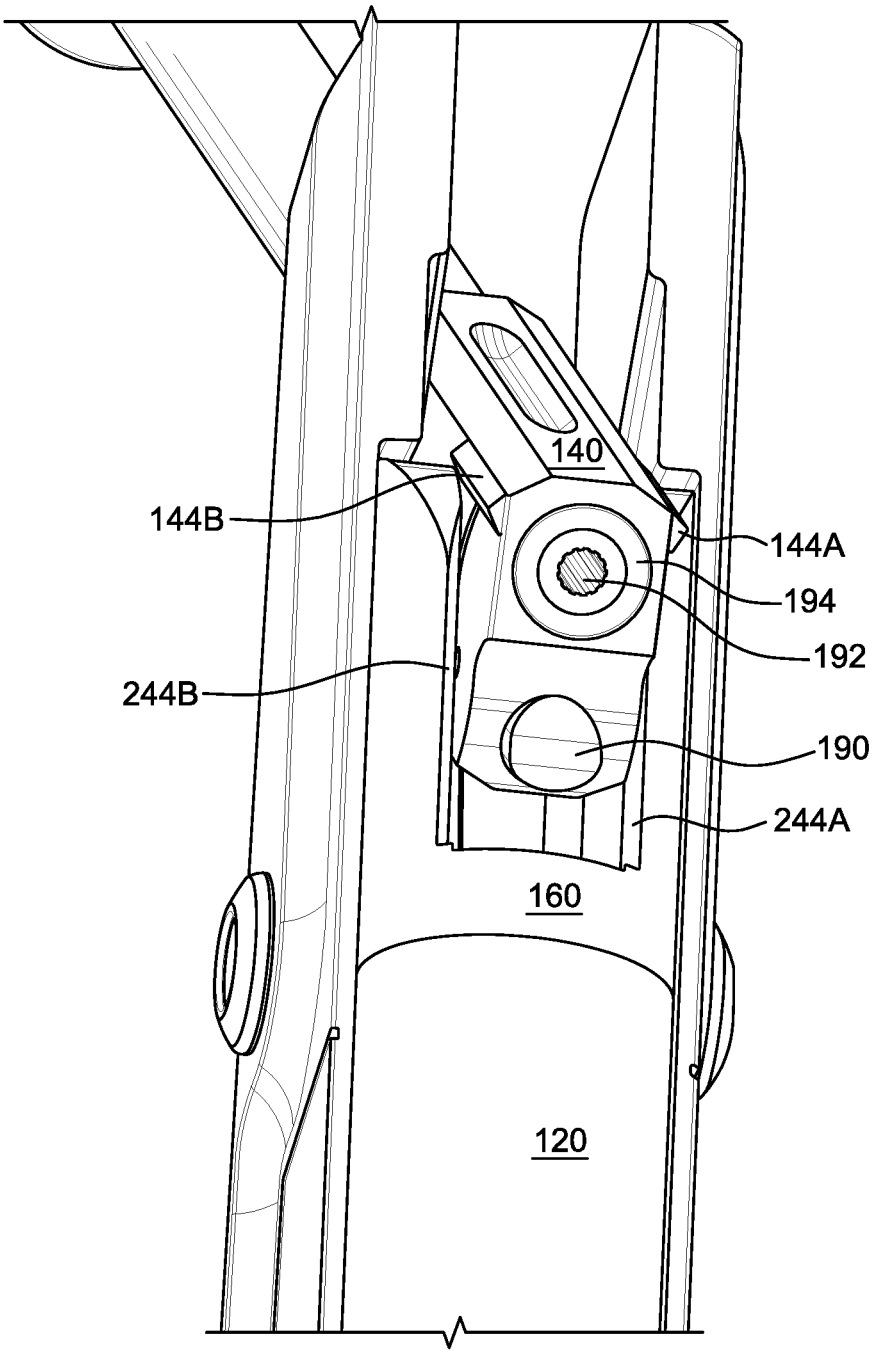
Figure 9C:
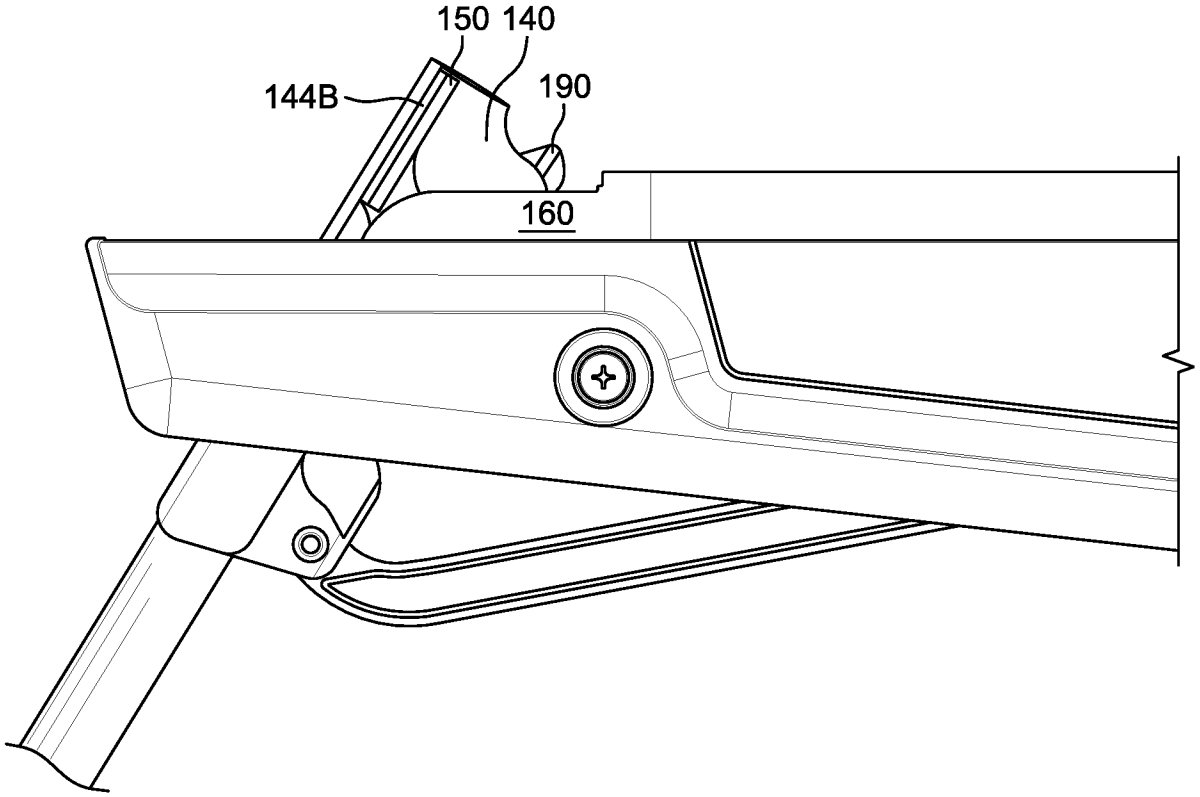

FIGS. 9A, 9B and 9C provide perspective views of the barrel block 140 and compression fork 160 in an assembled air gun 100. The figures show the assembly with the breech open with the barrel 110 approximately half way cocked. Lower wedge surface 150 is free of inclined shelf 244. Also shown in the rear face of barrel block 140 is pellet receiving orifice 192 and o-ring 194 for providing a seal between the compression fork 160 and the barrel block 140 and barrel 110. Plunger 190 can be spring loaded and is biased outwardly, away from the barrel block 140. Plunger 190 interacts with a detent post (not shown) that extends from the rear wall 250 (see FIG. 7) of compression fork 160. As the barrel and breech are closed, the plunger 190 contacts the detent post and is compressed against the spring toward the barrel block 140. After passing over the detent post, the plunger 190 is extended outwardly by the spring and interacts with the detent post to prevent opening of the air gun 100 without leveraged force provided by the user. In many embodiments, plunger 190 has moved past the tip of the detent post and is fully or mostly re-extended when wedges 144 come into contact with inclined shelves 244. The interaction between plunger 190 and the detent post provides the force necessary to keep the surfaces of wedges 144 and inclined shelves 244 in compression against each other.

Manufacturing Process

Barrel block 140 and compression fork 160 are pivotally connected using barrel pivot pin 172 along with any associated bushings to reduce wear and friction. To receive the barrel pivot pin 172, holes are drilled through both compression fork 160 and barrel block 140. Traditionally, the barrel block 140 and compression fork 160 are drilled separately with hole tolerances designed to allow for variations in part dimensions. Shims, which must be selected individually for each air gun, have been used help to eliminate side to side movement by reducing or eliminating and space between the fork 160 and barrel block 140 at the pivot point.

In one set of embodiments, the compression fork 160 and barrel block 140 are match drilled at the same time. Prior to any hole being drilled for the barrel pivot pin 172, the barrel block 140 and compression fork 160 are placed together in the firing mode configuration. Lower surfaces 150 of wedges 144A and 144B are in full contact with inclined shelves 244A and 244B of compression fork 160. At the same time, barrel block 140 is pushed into compression fork 160 so that the two surfaces are in contact, or close to contact, and are in an optimal configuration for firing. This position is the preferred position for the barrel block 140 in relation to the compression fork 160 and the barrel pivot pin 172 is used to fix them in position. With the wedges 144 and shelves 244 in contact, and the rear surface of barrel block 140 in contact (or close) with rear wall 250 of compression fork 160, the components are clamped together and the barrel pivot pin hole is match drilled through both the fork 160 and barrel block 140 in a single step. The hole is drilled in the barrel block 140 at region 152 which protrudes several thousandths of an inch to provide clearance between the barrel block 140 and the compression fork 160 when the barrel 110 is pivoted. Match drilling removes the need for the tolerances in the pivot pin holes that would normally be required when the fork 160 and barrel block 140 are drilled separately. This process also eliminates the needs for shims between the compression fork 160 and barrel block 140 because the horizontal support provided by the wedge/shelf interface means that the barrel block 140 and compression fork 160 do not need to rub against each other at the pivot point. Any lateral sliding or rotation is prevented by the interaction of the wedges 144 and shelves 244. Vertical play is also decreased because the barrel pivot pin 172 and bushing fit precisely into the pivot pin hole, effectively eliminating any vertical movement at that point. Friction and wear between the outer surfaces of the barrel block 140 and the inner surfaces of the compression fork 160 are reduced or eliminated because they no longer need to be in contact to provide steady positioning of the barrel 110. This reduction in wear results in greater accuracy and less frequent adjustment of sighting devices.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. A break barrel air gun comprising:

a barrel block attached to a barrel, the barrel block having two opposed substantially vertical sides, each side including a wedge extending laterally outwardly; and a compression fork pivotally attached to the barrel block, the compression fork including two inclined shelves each having upper surfaces configured to contact lower surfaces of the wedges when the air gun is in a closed configuration.

2. The air gun of claim 1, wherein the lower surfaces of the wedges extend laterally at an angle between 90° and 180° from the vertical sides of the barrel block.

3. The air gun of claim 1, wherein the lower surfaces of the wedges extend laterally at an angle greater than 110° from the vertical sides of the barrel block.

4. The air gun of claim 1, wherein the lower surfaces of the wedges and the upper surfaces of the inclined shelves are planar.

5. The air gun of claim 1, wherein the surface area of a wedge in contact with an inclined shelf is greater than 0.25 $cm^2$.

6. The air gun of claim 1, wherein the length of a wedge is greater than 10 mm.

7. The air gun of claim 1, wherein the wedges are formed on an upper surface of the barrel block.

8. The air gun of claim 1, wherein the wedges are formed integrally into the barrel block.

9. The air gun of claim 1, wherein the compression fork is attached to a compression tube so that the compression tube, compression fork, barrel block, and barrel are in fluid communication with one another.

10. The air gun of claim 9, wherein the wedges are in contact with the inclined shelves to maintain at least one of horizontal alignment and vertical alignment of the barrel with the compression tube when the air gun is in a ready to fire position.

11. The air gun of claim 9 further comprising a stock connected to the compression fork and a scope mounted on the compression tube.

12. The air gun of claim 1, wherein the wedges include a triangular cross-sectional shape.

13. The air gun of claim 1, wherein the wedges are one of a continuous plane or a plurality of interrupted co-planar segments.

14. The air gun of claim 1, wherein the lower surfaces of the wedges are curved surfaces configured to contact upper curved surfaces of the inclined shelves.

15. The air gun of claim 1, wherein the wedges include a length to width ratio of greater than 2:1.

16. The air gun of claim 1, wherein the barrel block further includes a detent configured to maintain the wedges of the barrel block in contact with the inclined shelves of the compression fork.

17. The air gun of claim 1, wherein the compression fork includes a pair of arms on which the inclined shelves are disposed, the inclined shelves extending downwardly toward an inside surface of each arm.

18. A method of making an air gun, the method comprising:

joining a barrel block to a compression fork so that wedges disposed on the barrel block are in contact with inclined shelves disposed on the compression fork;

match drilling a pivot pin hole through the compression fork and the barrel block; and pivotally securing the compression fork to the barrel block by passing a pivot pin through the pivot pin hole.

19. The method of claim 18 further comprising pressing a breech face of the barrel block against a corresponding face of the compression fork prior to drilling.

20. The method of claim 18, wherein the barrel block is joined with the compression fork so that the barrel block and compression fork are placed together in a firing mode configuration.

* * * * *